US005881498A

United States Patent [19]

Goggin et al.

[11] Patent Number: 5,881,498

[45] Date of Patent: Mar. 16, 1999

[54] TILT AND TURN WINDOW LOCK SYSTEM

[75] Inventors: Christopher M. Goggin, Wilmington, N.C.; Harry M. Riegelman, Arlington, Tex.; Francis Manzella, Rockville Center, N.Y.

[73] Assignee: Thermo-Roll Window Corp., W. Babylon, N.Y.

[21] Appl. No.: 944,057

[22] Filed: Sep. 27, 1997

[51] Int. Cl.[6] ..... E05D 15/52

[52] U.S. Cl. ..... 49/192; 49/394

[58] Field of Search ..... 49/192, 183, 187, 49/394, 382

[56] References Cited

U.S. PATENT DOCUMENTS

| | | | |
|---|---|---|---|
| 2,969,566 | 1/1961 | Mayer | 20/53 |
| 3,667,162 | 6/1972 | Lalagüe | 49/192 |
| 3,911,621 | 10/1975 | McHeffey | 49/192 |
| 3,994,093 | 11/1976 | Mayer et al. | 49/192 |
| 4,074,462 | 2/1978 | McHeffey | 49/192 |
| 4,339,892 | 7/1982 | Ulbricht et al. | 49/192 |
| 4,420,905 | 12/1983 | Kucharczyk | 49/192 |
| 4,541,200 | 9/1985 | Gartner | 49/192 |
| 4,602,457 | 7/1986 | Kreusel | 49/192 |
| 4,624,075 | 11/1986 | Vigreux | 49/192 |
| 4,679,352 | 7/1987 | Bates | 49/192 |
| 5,076,015 | 12/1991 | Manzalini | 49/192 |

FOREIGN PATENT DOCUMENTS

| | | |
|---|---|---|
| 566791 | 8/1960 | Belgium . |
| 1272163 | 7/1968 | Germany . |
| 2234530 | 1/1974 | Germany . |
| 2166814 | 3/1976 | Germany . |

*Primary Examiner*—Jerry Redman
*Attorney, Agent, or Firm*—Robert A. Seemann

[57] ABSTRACT

In a multi-position window that has a window sash that is rotatable out of the window frame on at least two different axis on pivots which are changed by a drive train on the sash moving to positions, the improvement includes one of a spring driven bolt and a strike on the window sash being moved by the drive train into alignment and engagement with the other on the window frame and with a hole for a tool to retract the bolt from the strike.

5 Claims, 6 Drawing Sheets

TILT AND TURN WINDOW LOCK SYSTEM

BACKGROUND OF THE INVENTION

1. Field of the Invention

This invention pertains to locking of tilt and turn windows, more specifically to a movable window mounted for optional movement on alternative axis having a security lock integral with the axis selection mechanism.

2. Description of the Prior Art

There are many designs for window security locks. A lock for preventing movement of the window sash about one axis of a tilt and turn window should operate without interfering with movement of the window sash about the other axis.

One lock design has a housing externally mounted on the lower horizontal bar of the sash frame at the end that is distal from the vertical hinge axis. The housing contains a key operated bolt axle which rotates on a horizontal axis normal to the bar. In the locked position a finger at the end of the bolt axle is turned downward whereby it slips into an upward open slot in the bottom horizontal bar of the window frame. In the unlocked position, the finger is rotated out of the slot to the horizontal within the horizontal sash frame bar.

In the locked position, the finger in the slot prevents the sash from rotating on the window vertical axis out of the window frame. In order to be able to tilt the sash on the window horizontal axis, the lock must be unlocked unless in order to be able to tilt the sash with the lock locked the bolt finger and slot are mounted close to the window horizontal axis at the bottom of the sash about which the sash tilts, the slot is made wide enough in the direction of the bolt axle axis compared to the axial thickness of the finger to allow the sash to tilt on the window horizontal axis while the bolt is in the locked position. Then, with rotation of the lower bar of the sash, the bolt tilts in the slot and may also be partially withdrawn from the slot as it moves on the arc of sash rotation.

U.S. Pat. No. 4,624,075 patented Nov. 25, 1986 by D. Vigreux describes a turn, tilt window having a drive train control rod in the sash frame which by linear movement over three discrete distances driven by a three-position handle switches the sash from lockdown in the window frame to rotation on a vertical axis to rotation on a horizontal axis, in which the alignment position one of a lock and keeper mounted on the control rod so that it moves with the rod to engage the other of the lock and keeper on the window frame can be changed by moving the lock or keeper from a first position to a second linearly displaced mount position.

U.S. Pat. No. 3,911,621 patented Oct. 14, 1975 by M. P. McHeffey describes a tilt and turn window having a drive train around three sides of the sash. The drive train is moved linearly by a three-position handle to switch the sash from lockdown in the window frame to rotation out of the window frame on a vertical axis to rotation out of the window frame on a horizontal axis.

When the handle is moved upwardly from center position the drive train is moved counterclockwise setting the window sash for rotation or tilt out of the window frame on the horizontal axis and moving a finger behind a keeper attached to an outer vertical member of the window frame to prevent rotation of the sash out of the window frame on the vertical axis. When the handle is moved downward from the center position, the train moves clockwise setting the window sash for rotation out of the window frame on the vertical axis.

A key operated lock mechanism having a finger that is rotated by the key is installed just past the clockwise end of the drive train and positioned so that the finger can be turned linear with the drive train so that it occupies the most clockwise position of the end of the drive train that sets the window sash for rotation on the vertical axis, thereby preventing rotation on the vertical axis. Tilt on the horizontal axis is unaffected because the drive train moves counterclockwise away from the lock for that mode. The finger can be turned normal to linear motion of the drive train to allow rotation of the sash on the vertical axis.

U.S. Pat. No. 4,074,462 patented Feb. 21, 1978 by M. P. McHeffey describes a tilt and turn window having a drive train similar to the one described in his U.S. Pat. No. 3,911,621 having a key operated mechanism is at the end of the drive train, but in which the key operated mechanism mounted on the frame of the sash extends a bolt into a longitudinal slot located in the drive train so that one end of the slot coming against the bolt prevents sufficient linear movement of the drive train to set the window sash for rotation out of the window frame on the vertical axis. The slot is long enough to permit linear movement of the drive train in the opposite direction to set the sash for tilt or rotation on the horizontal axis. Drawing the bolt back with the key permits linear movement of the drive train to set the window sash for rotation on the vertical axis.

SUMMARY OF THE INVENTION

It is one object of the invention to provide a tilt and turn lock system in a tilt and turn window having a drive train that can be moved, preferably by a handle, to at least two positions, the first position configures the sash for rotation out of the window frame on a horizontal axis of the window, the second position configures the sash for rotation out of the window frame on a vertical axis of the window. The tilt and turn window drive train may also be movable to a third position which locks the sash in the window frame in the window closed position.

It is another object that the system locks the window sash closed when the drive train is in the second position wherein the window is configured for rotation of the sash out of the window frame on the vertical axis of the window.

It is another object of the invention that the window can be unlocked so that the sash can be rotated out of the window on the vertical axis when the drive train is in the second position wherein the window is configured for rotation of the sash on the vertical axis.

It is another object that a key is required to unlock the window to permit the sash to be rotated on the vertical axis when the drive train is in the second position for rotating the window on the vertical axis.

It is another object that the key operates a lock mechanism comprising a bolt mechanism and a strike, an element of which is moved by the drive train to a key access port in the window when the drive train is moved to the second position for rotation of the sash on the vertical axis.

It is another object that the drive train movable element of the lock mechanism is away from the key access port thereby being unaccessible to the key through the key access port when the drive train is in the first position for rotation of the sash on the horizontal axis out of the window frame.

It is another object that the drive train movable element of the lock mechanism is away from the key access port when the drive train is in the third position that locks the window closed while the sash is in the window closed position.

It is another object that the key and port are configured to prevent movement of the drive train away from the position which sets the window for rotation of the sash on the vertical axis, while the key is in the port.

Other objects and advantages will become apparent from reading the ensuing description of the invention.

In a multi-position window that has a window frame, a sash frame that is rotatable out of the window frame on at least two different axis, a drive train mounted on at least one side of the sash frame for longitudinal movement along a length of the side to a plurality of positions and being operatively connected to pivot means for changing the axis of rotation of the sash from a first axis when the drive train is at a first position to a second axis when the drive train is at a second position, an improvement comprises, a bolt, a strike configured to receive the bolt, one of the strike and bolt being mounted on the window frame fixed against the longitudinal movement of the drive train, the other of the strike and bolt being mounted on the sash frame for movement by the drive train along the side and so that the strike and bolt are in alignment for the strike to receive the bolt when the drive train is in the second position the bolt comprising means for resiliently urging the bolt into the strike, and the strike and the bolt are out of alignment for the strike to receive the bolt when the drive train is in the first position.

The strike and the bolt are operative on one another to move the bolt out of the strike when the strike and the bolt are being moved out of alignment by movement of the drive train from the second position to the first position.

Surfaces on the strike and the bolt are operative on one another to move the bolt out of the strike when the strike and the bolt are being moved out of alignment by movement of the drive train from the second position to the first position.

A hole in the sash frame is in alignment with the bolt and the strike when the drive train is in the second position for insertion of a key through the hole for moving the bolt out of the strike, and is in alignment with one of the bolt and the strike and out of alignment with the other of the bolt and the strike when the drive train is in the first position.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
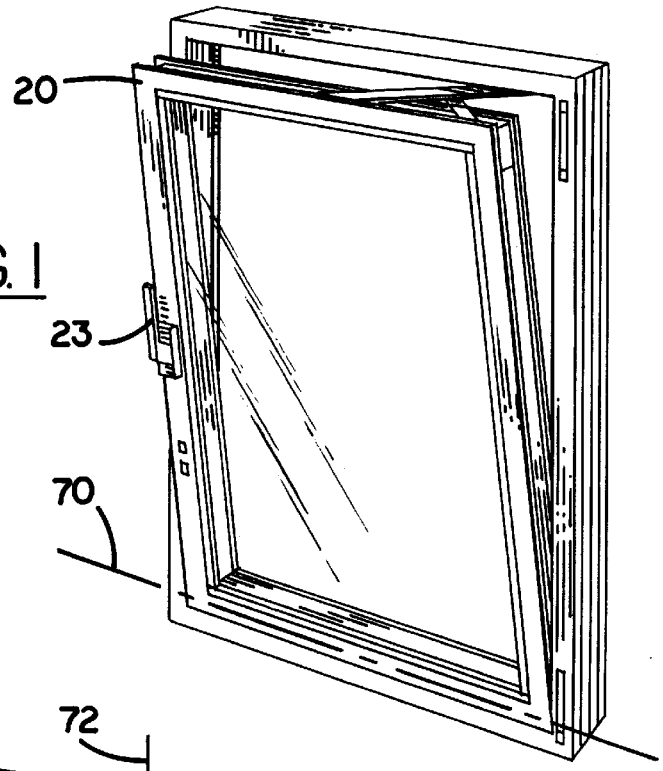
FIG. 1 is a perspective schematic view of a tilt and turn window in which the sash is rotated out of the window frame on a horizontal axis of the window.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

The invention is designed to be operated in part by the drive train of a multi-position window such as a tilt and turn window. The drive train is usually mounted on the sash frame and extends around two or more edges of the sash frame including means for carrying linear motion of the drive train around the corners of the sash frame to appropriate locations in the window where the drive train configures pivot means for rotating the sash frame in the window frame on selected axis such as horizontal and vertical axis.

Designs for drive trains for tilt and turn windows are well known in the art, and need not be described in this disclosure. For example, they are discussed in U.S. Pat. Nos. 3,911,621, 4,074,462, 4,624,075 (control rod 7), and U.S. Pat. No. 4,339,892.

A portion of a drive train upon which an element of the invention is mounted is included herewith.

Referring to FIGS. 1–9, the invention comprises bolt mechanism 24 and strike 22. Strike 22 receives bolt 40 of bolt mechanism 24 in slot 28. Bolt mechanism 24 is mounted on drive train 30 which moves 46 in response to handle movement, in linear movement along lengthwise groove 38 around the edge of window sash 20 frame 36.

Figure 2:
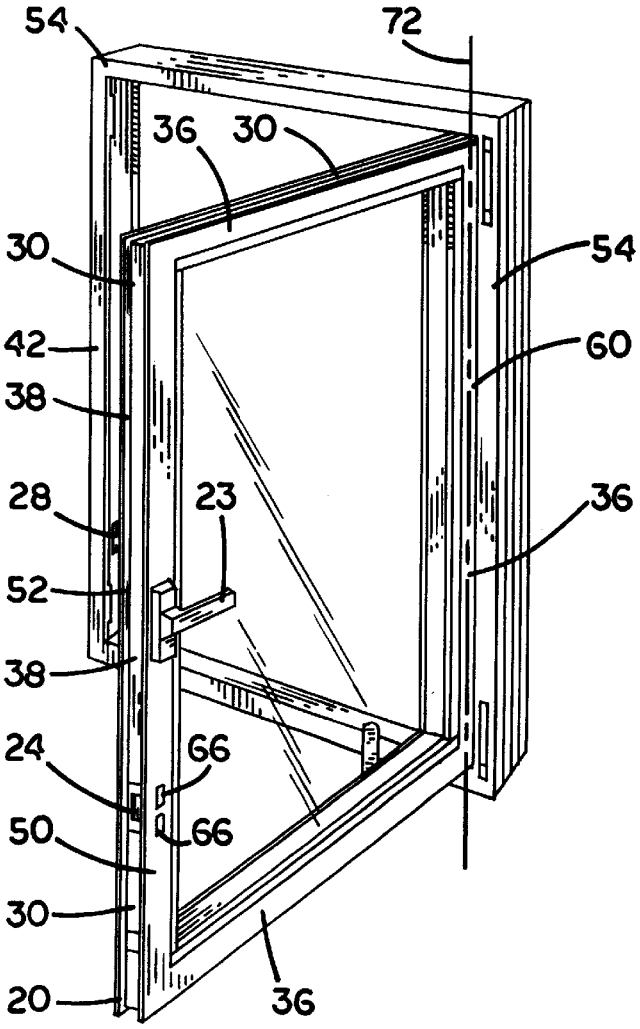
FIG. 2 is a perspective schematic view of the window of FIG. 1 in which the sash is rotated out of the window frame on a vertical axis of the window. A portion of the tilt and turn lock system installed in the window is shown.
Figure 6:
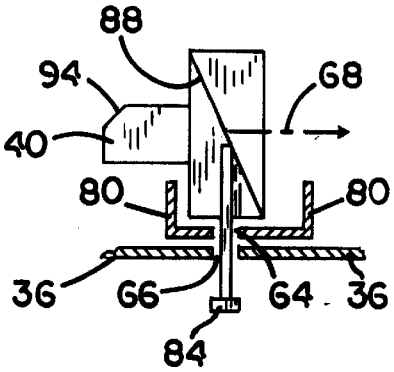
FIG. 6 is a top view of the bolt of the lock system of FIG. 4.
Figure 7:
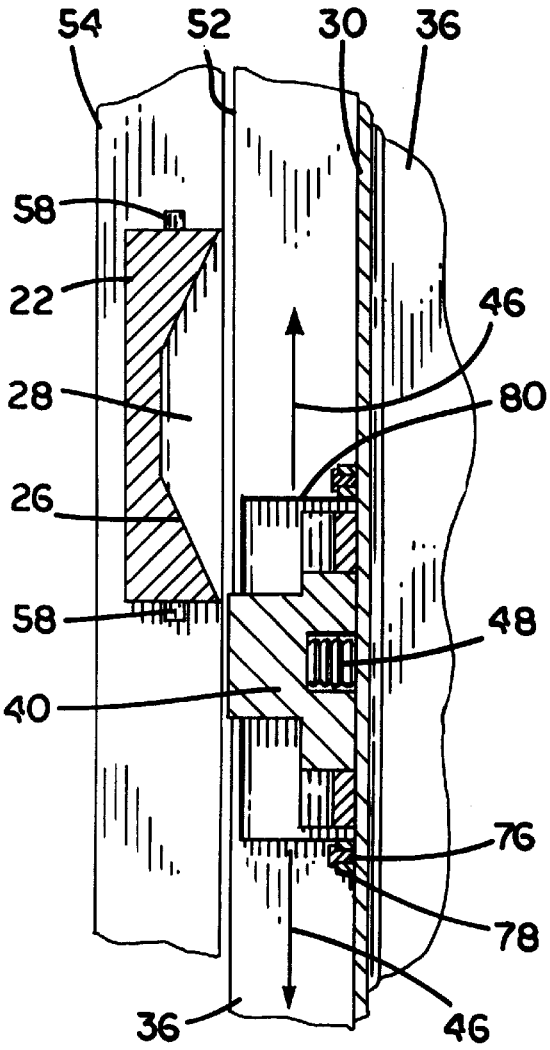
FIG. 7 is a schematic cross section front view of the lock system of FIG. 4, with the drive train moved to another position.
Figure 8:
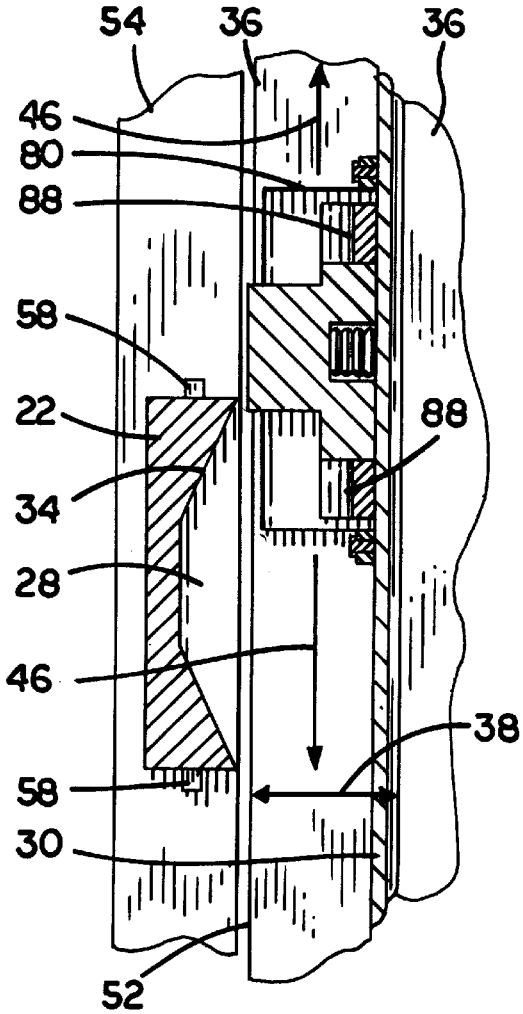
FIG. 8 is a schematic cross section front view of the lock system of FIG. 4, with the drive train moved to another position.
Figure 9:
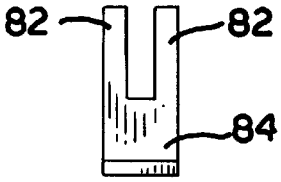
FIG. 9 is a side view of a key for moving back the bolt of the lock system.

The portions of the sash frame and the window frame that overlay the strike, bolt mechanism and drive train are omitted in FIGS. 2, 7, and 8 for clarity of description of the elements. The portion of the sash frame through which the key fingers are inserted is shown in FIG. 6.

Drive train 30 is moved by handle 23 to at least two positions.

Position 1 configures pivot means of the window for rotation of the sash frame out of the window frame on a horizontal axis of the window pivot means.

Position 2 configures pivot means of the window for rotation of the sash out of the window frame on a vertical axis of the window pivot means. The tilt and turn window drive train may be designed to be movable to a third position which brings into engagement, window locks that lock the sash in the window frame in the window closed position.

In FIG. 1, handle 23 is turned upwards, the drive train is in position 1, and the sash frame is rotated out of the window frame on horizontal axis 70 through pivots not shown.

In FIG. 2, handle 23 is horizontal, the drive train is in position 2, and the sash frame is rotated out of the window frame on vertical axis 72 through pivots not shown.

Figure 3:
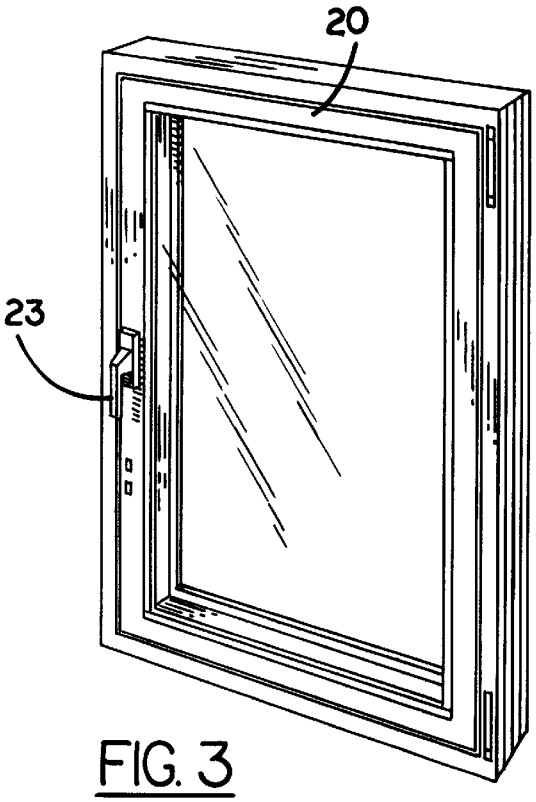
FIG. 3 is a perspective schematic view of the window of FIG. 1 in which the sash is in the window closed position.
Figure 5:
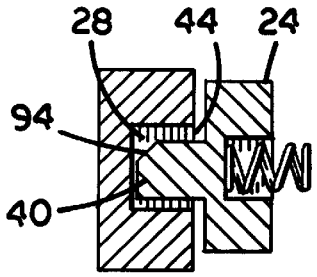
FIG. 5 is a partial cross section view of the lock of FIG. 4 taken along 5—5.

In FIG. 3, handle 23 is turned downward, the drive train is in position 3 at which catch means (not shown) between the drive train and the window frame locks the window closed.

Bolt mechanism 24 is fixedly mounted on drive train 30 by attachment bracket 76 on bolt mechanism housing 80 and rivets 78. Drive train 30 moves 46 bolt mechanism 24 along the edge 52 of window sash 20 frame 36 into engagement with slot 28 of strike 22 which is fixedly mounted by fasteners 58 on outer vertical member 42 of window frame 54. Bolt 40 of bolt mechanism 24 may be withdrawn from the slot with a key.

A preferred embodiment wherein the drive train moves the bolt mechanism longitudinally in groove 38 and longitudinally in slot 28 is described as follows:

Referring to FIGS. 1–9:

Position 1 sash movement—The top of the sash frame tilts out of the window frame, as the sash frame rotates on pivot means located at the bottom of the sash between the sash and the window frame.

handle—Vertical up.

slot 28—Is fixed on outer vertical member of the window frame.

bolt mechanism—Is below slot, FIG. 7.

bolt 40—Is below slot, cammed back to face plate 44 by lower chamfer 26 of slot 28 when the handle moved the bolt mechanism from position 2 to position 1.

bolt mechanism keyway 64—Is not aligned with keyway 66 in the sash frame.

system and window locks—Are unlocked to allow tilt out by top of sash, while engaging and holding sash bottom by horizontal pivot means.

Figure 4:
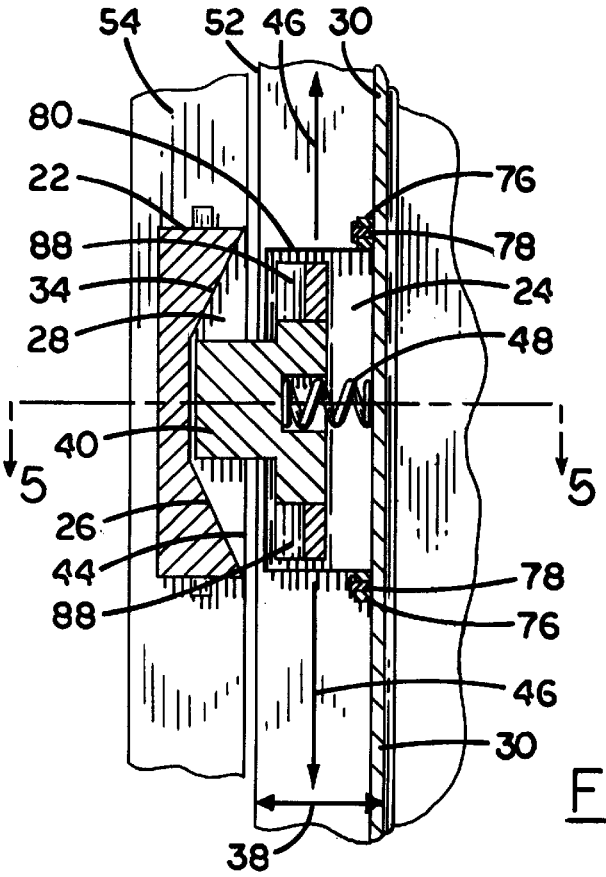
FIG. 4 is a schematic cross section front view of a lock system of the invention mounted on the drive train of the window of FIG. 1 according to the invention.

Position 2 sash movement—One side of sash, i.e. outer vertical member 50 of the sash can rotate out of the window frame 54 and away from the adjacent outer vertical member 42 of the window frame, while the other side of the sash 60 pivots on vertical pivot means between the sash and window frame. But bolt mechanism prevails and prevents the rotation unless the bolt is moved back.

handle—Horizontal slot—Is fixed on outer vertical member of the window frame.

bolt mechanism—Is aligned with slot, FIG. 4.

bolt—Extends into slot under urging of spring 48, prevents rotation of window sash on the vertical axis because it prevents the sash outer vertical member that has the bolt from leaving the adjacent outer vertical member of the window frame. The bolt, however, can be cammed back 68 out of the slot by fingers 82 of key 84 against identical cams 88 on the top and bottom of the bolt, pushing back the bolt so that the sash frame vertical member can leave the adjacent window frame vertical member and the window can be rotated sideways on the vertical pivot means located on the other outer vertical member of the window and outer vertical member of the sash at the other side 60 of the sash.

bolt mechanism keyway 64—Is aligned with the sash outer vertical member keyway 66.

system and window locks—Are unlocked to allow the sash to rotate open sideways, while engaging and holding the sash on one vertical side by vertical pivot means.

Position 3 handle—Vertical down.

slot—Is fixed on outer vertical member of window frame.

bolt mechanism—Is above slot, FIG. 8.

bolt—Is above slot, was cammed back to face plate by upper chamfer 34 of slot when handle moved the bolt mechanism from position 2 to position 3. This is optional, as upper chamfer of slot may be omitted and slot be extended so that the bolt remains in the slot as an additional lock against opening the window.

bolt mechanism keyway—Is not aligned with keyway in outer frame member of sash.

system lock unlocked; window locks engaged so that the sash top cannot tilt open, and the sash cannot rotate sideways out of the window frame.

Cam back of the bolt is automatic in position 1, and is not necessary in position 3.

In position 2, after the window is rotated horizontally open, if the key is removed the bolt will extend and not permit the window to be closed. The vertical edge of the bolt that would engage the edge of the outer vertical member of the window frame or the edge of the face plate when the sash is rotated to the outer vertical member of the window frame for closing the window can be chamfered 94 so that the edge of the face plate cams the bolt back to permit closing the window without key 84.

Referring to FIGS. 10–14, showing another preferred embodiment of the invention, the strike is mounted fixedly on the drive train and is moved by the drive train on the sash frame, while the bolt mechanism is fixedly mounted in the window frame.

This provides a benefit for easy retrofit of existing windows by installation of the invention in the windows. The strike plate, having less depth than the bolt mechanism, can be mounted on the surface of the drive train with screws, with no further modification of the drive train such as cutting a hole in the drive train to make room for the strike. It is simpler, faster, and less costly to cut a recess in the window frame for the bolt mechanism, than to disassemble the drive train on the sash frame to install the bolt mechanism on the drive train.

The portions of the sash frame and the window frame that overlay the strike, bolt mechanism and drive train are omitted in FIGS. 10, 11, 12, and 14, for clarity of description of the elements.

Strike 122 receives bolt 140 of bolt mechanism 124 in slot 128. Strike 122 is mounted on drive train 130 which moves 146 in response to handle movement, in linear movement along lengthwise groove 138 around the edge 152 of window sash frame 136. The sash frame and window frame is similar to sash frame 36 and window frame 54 described above. A portion of a drive train upon which an element of the invention is mounted is included herewith.

Drive train 130 is moved by handle 123 to at least two positions.

Position 1 configures pivot means of the window for rotation of the sash frame out of the window frame on a horizontal axis of the window pivot means.

Position 2 configures pivot means of the window for rotation of the sash out of the window frame on a vertical axis of the window pivot means. The tilt and turn window drive train may be designed to be movable to a third position which brings into engagement, window locks that lock the sash in the window frame in the window closed position.

When the handle is turned upwards, the drive train is in position 1, and the sash frame is rotated out of the window frame on a horizontal axis.

When the handle is horizontal, the drive train is in position 2, and the sash frame is rotated out of the window frame on a vertical axis.

When the handle is turned downward, the drive train is in position 3 at which catch means between the drive train and the window frame locks the window closed.

Strike 122 is fixedly mounted on drive train 130 by attachment bracket 200 and screws 204. Drive train 130 moves strike 122 along edge 152 of window sash frame 136 into engagement with bolt 140 of bolt mechanism 124 which is fixedly mounted on window fame outer vertical member 142.

Bolt 140 of bolt mechanism 124 may be withdrawn from slot 128 by key 222 that is inserted into key access port 206 in the sash frame in front of glass pane 226 and forces the bolt back against spring 148 and from and out of the slot. Preferably the key forces the bolt back by pressing on the face 210 of the bolt. The key, however, may be designed to press on another element that moves the bolt back and is brought into alignment with the key access port by the drive train, which thereby is also defined as the bolt being in alignment with the key port.

Figure 11:
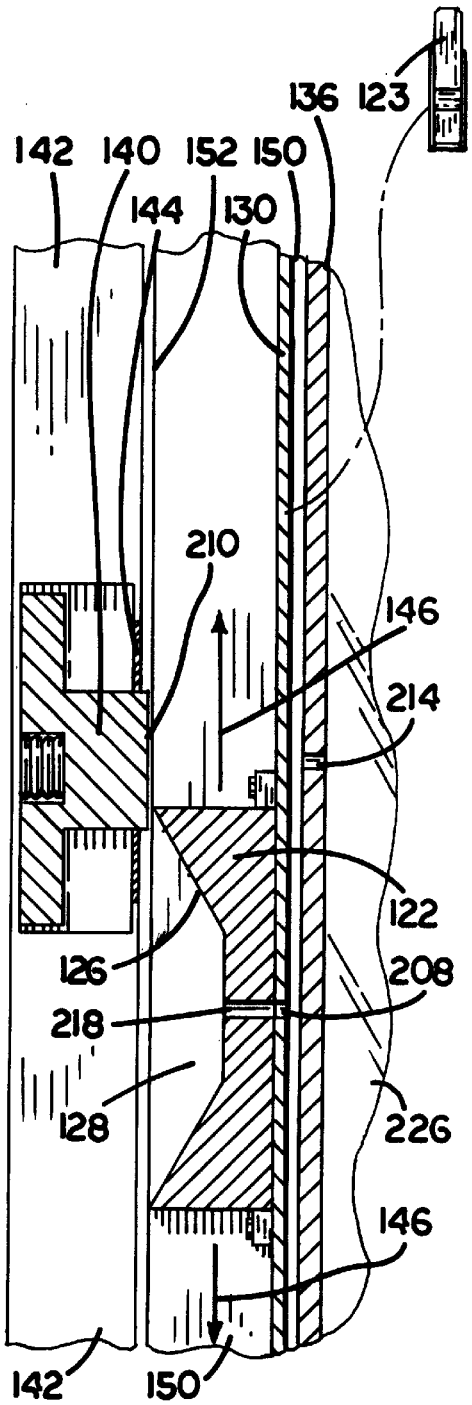
FIG. 11 is a schematic cross section of the lock system of FIG. 10 with the drive train moved to another position.

This preferred embodiment wherein the drive train moves the strike and slot 128 longitudinally in groove 138 whereby slot 128 moves longitudinally with the drive train with respect to bolt 140 is described as follows:

Referring to FIGS. 10–15;

Position 1 sash movement—The top of the sash frame tilts out of the window frame, as the sash frame rotates on pivot means located at the bottom of the sash between the sash and the window frame.

handle—Vertical up.

bolt mechanism 124—Is fixed on outer vertical member of the window frame 142.

slot 128—Is below bolt, FIG. 11.

bolt 140—Is above slot, cammed back to face plate 144 by upper chamfer 126 of slot 128 when the handle moved the bolt mechanism from position 2 to position 1.

strike slot keyway 218—Is not aligned with keyway 214 in the sash frame. Since strike slot 128 which should not align with keyway 214 in this position may extend lengthwise along the line of movement of the drive train, a shorter strike slot keyway fixedly aligned with strike slot 128 is provided by making a hole through the base of the strike and a hole 208 through the drive train or in a back wall of the strike, wherein the width of the hole in the direction of movement of the drive train is made small.

system and window locks—Are unlocked to allow tilt out by top of sash, while engaging and holding sash bottom by horizontal pivot means.

Figure 10:
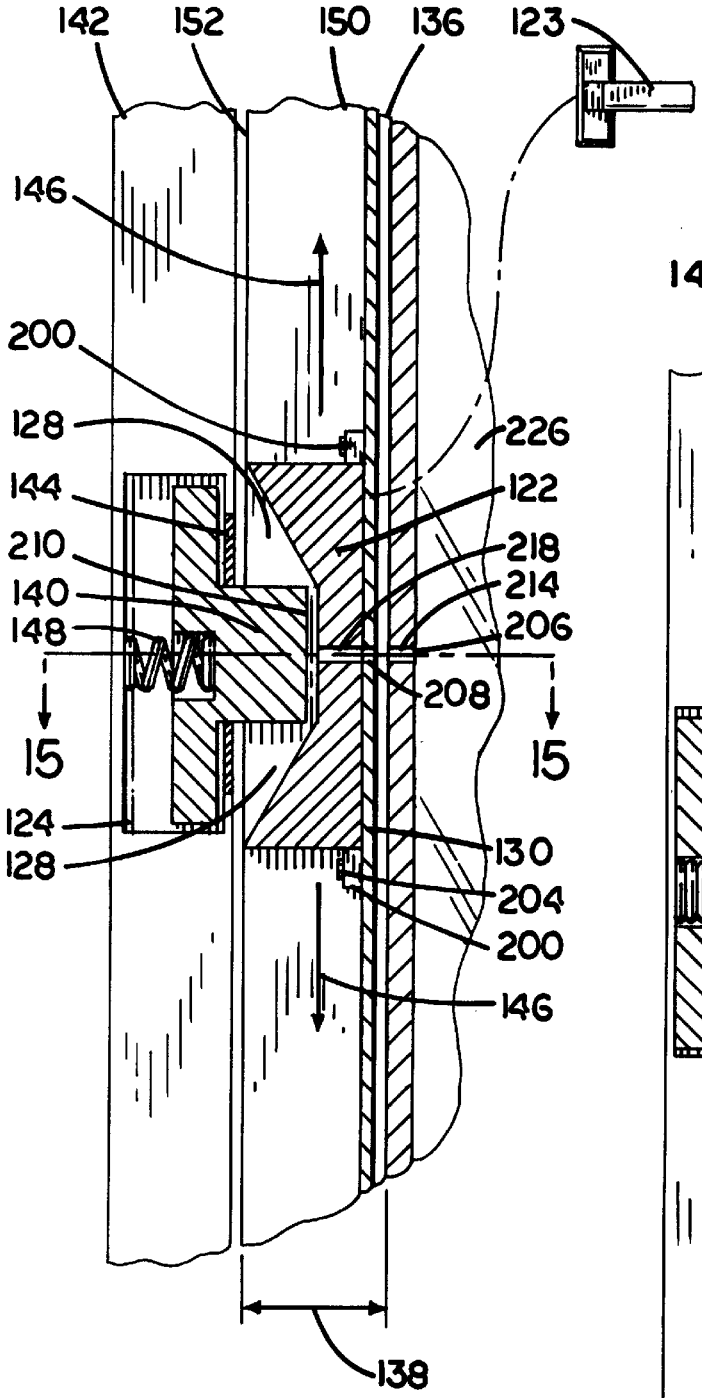
FIG. 10 is a schematic cross section front view of another lock system of the invention.

Position 2 sash movement—One side of sash, i.e. outer vertical member 150 of the sash can rotate out of the window frame and away from the adjacent outer vertical member 142 of the window frame, while the other side of the sash pivots on vertical pivot means between the sash and window frame. But bolt mechanism prevails and prevents the rotation unless the bolt is moved back.

handle—Horizontal bolt mechanism 124—Is fixed on outer vertical member of the window frame.

slot 128—Is aligned with bolt, FIG. 10.

bolt—Extends into slot under urging of spring 148, prevents rotation of window sash on the vertical axis because it prevents the sash outer vertical member, that has the slot, from leaving the adjacent outer vertical member of the window frame.

Figure 14:
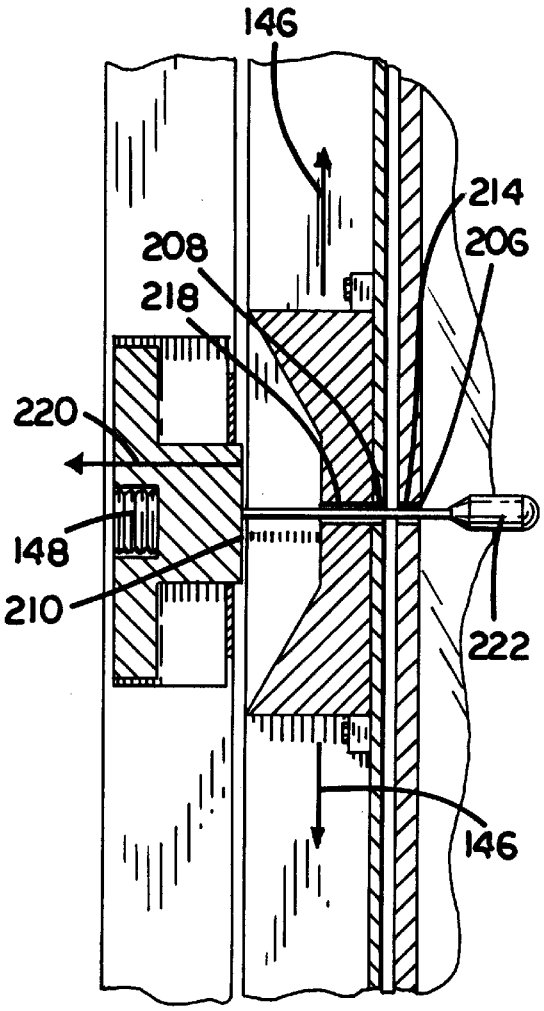
FIG. 14 is a schematic cross section front view of the lock system of FIG. 10.
Figure 15:
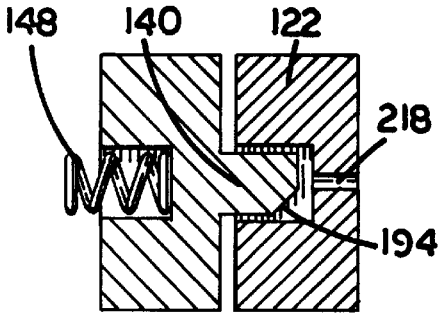
FIG. 15 is a partial cross section view of the lock of FIG. 10 taken along 15—15.

However, referring to FIG. 14, the bolt can be pushed back 220 out of the slot by key 222 against cam bolt face 210, pushing back the bolt so that the sash frame vertical member can leave the adjacent window frame vertical member and the window can be rotated sideways on the vertical pivot means located on the other outer vertical member of the window and outer vertical member of the sash at the other side of the sash.

strike slot keyway 218—Is aligned with the sash outer vertical member keyway 214, forming key access port 206. system and window locks—Are unlocked to allow the sash to rotate open sideways, while engaging and holding the sash on one vertical side by vertical pivot means.

Position 3 handle—Vertical down.

bolt mechanism 124—Is fixed on outer vertical member of the window frame.

Figure 12:
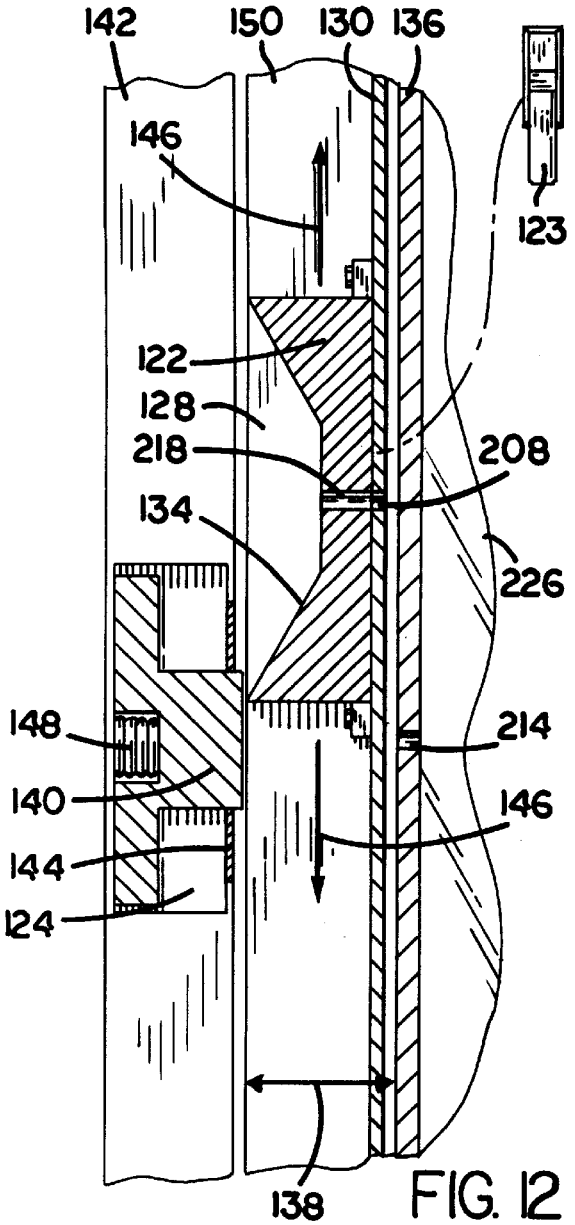
FIG. 12 is a schematic cross section of the lock system of FIG. 10 with the drive train moved to another position.
Figure 13:
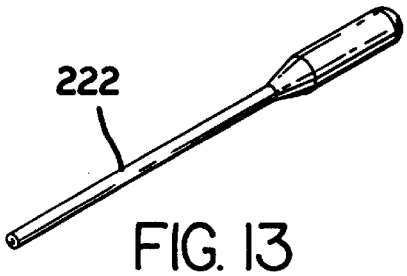
FIG. 13 is a perspective view of a key for the lock system of FIG. 10.

Slot 128 is above bolt, FIG. 12.

bolt—Is below slot, was cammed back to face plate by lower chamfer 134 of the slot when the handle moved the bolt mechanism from position 2 to position 3. This is optional, as the lower chamfer of the slot may be omitted and the slot can be extended so that the bolt remains in the slot as an additional lock against opening the window.

strike slot keyway—Is not aligned with keyway in outer frame member of sash.

system lock unlocked; window locks engaged so that the sash top cannot tilt open, and the sash cannot rotate sideways out of the window frame.

Cam back of the bolt is automatic in position 1, and is not necessary in position 3.

In position 2, after the window is rotated horizontally open, the bolt will extend and will not permit the window to be closed. The vertical edge of the bolt that would engage the edge of the outer vertical member of the window sash frame or the edge of the face plate when the sash is rotated to the outer vertical member of the window frame for closing the window can be chamfered 194 so that the edge of the face plate cams the bolt back to permit closing the window.

Figure 16:
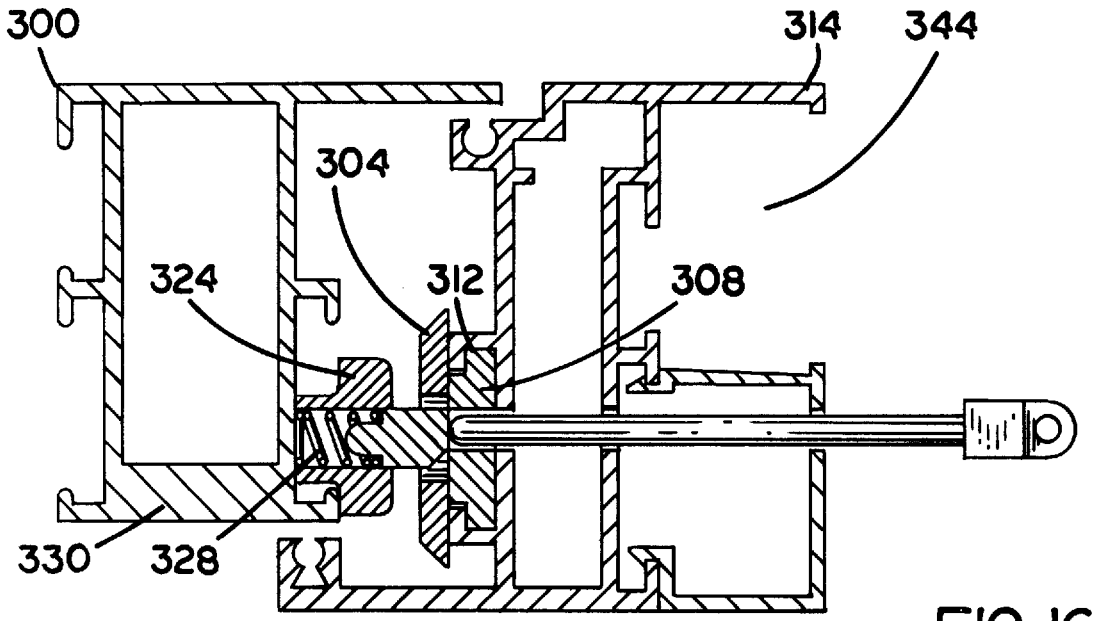
FIG. 16 is a schematic top partial cross section view of another lock system of the invention.
Figure 17:
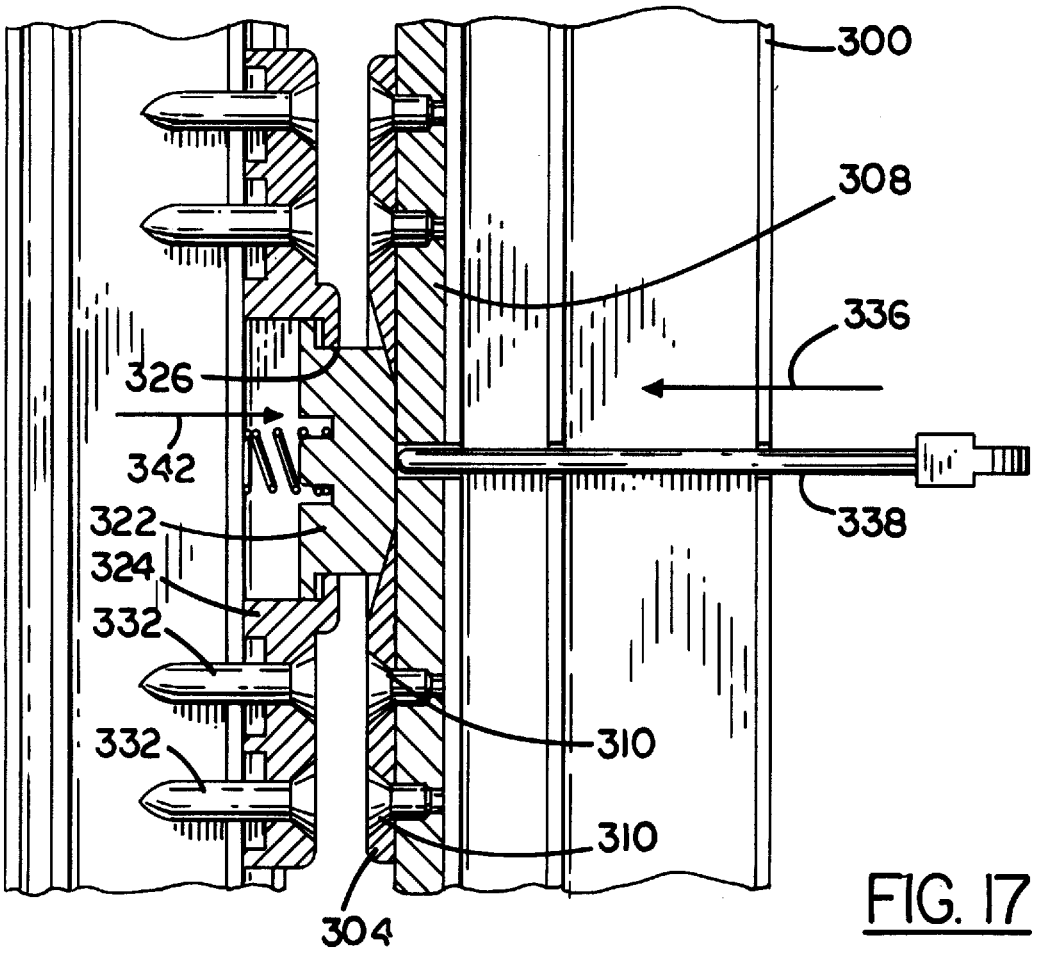
FIG. 17 is a schematic front partial cross section view of the lock system of FIG. 16.

FIGS. 16 and 17 show another embodiment of the invention in window 300, a portion of which is shown.

Strike 304 is fixedly attached to drive train 308 by fasteners 310. Drive train 308 moves in channel 312 of sash frame 314. Bolt 322 extends and retracts from bolt mechanism housing 324 opening 326 urged 342 toward the opening by spring 328. Housing 324 is fixedly attached to window frame 330 by fasteners 332.

The bolt can be moved back into housing 324, compressing spring 318, by force applied 336 to the bolt by key 338 in front of channel 344 for window glass.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. In a multi-position window having a window frame, a sash frame being rotatable out of the window frame on at least two different axis, a drive train mounted on at least one side of said sash frame for longitudinal movement along a length of the side to a plurality of positions and being operatively connected to pivot means for changing the axis of rotation of said sash from a first axis when said drive train is at a first position to a second axis when said drive train is at a second position, an improvement comprising;

a bolt, a strike configured to receive said bolt, one of said strike and bolt being mounted on said window frame fixed against said longitudinal movement of said drive train, the other of said strike and bolt being mounted on said sash frame for movement by said drive train along said side and so that said strike and bolt are in alignment for said strike to receive said bolt when said drive train is in the second position said bolt comprising means for resiliently urging said bolt into said strike, and said strike and said bolt are out of alignment for said strike to receive said bolt when said drive train is in the first position, a surface on said strike slidingly camming on a surface on said bolt to move said bolt out of said strike when said strike and said bolt are being moved across one another longitudinally with said drive train out of alignment by movement of said drive train from the second position to the first position, said bolt in said strike preventing rotation of said sash frame out of said window frame.

2. In a multi-position window having a window frame, a sash frame being rotatable out of the window frame on at least two different axis, a drive train mounted on at least one side of said sash frame for longitudinal movement along a length of the side to a plurality of positions and being operatively connected to pivot means for changing the axis of rotation of said sash from a first axis when said drive train is at a first position to a second axis when said drive train is at a second position, an improvement comprising;

a bolt, a strike configured to receive said bolt, one of said strike and bolt being mounted on said window frame fixed against said longitudinal movement of said drive train, the other of said strike and bolt being mounted on said sash frame for movement by said drive train along said side and so that said strike and bolt are in alignment for said strike to receive said bolt when said drive train is in the second position said bolt comprising means for resiliently urging said bolt into said strike, and said strike and said bolt are out of alignment for said strike to receive said bolt when said drive train is in the first position, a hole in the sash frame that is in alignment with said bolt and said strike when said drive train is in the second position for insertion of a key through said hole for moving said bolt out of said strike, and that is in alignment with one of said bolt and said strike and out of alignment with the other of said bolt and said strike when said drive train is in the first position.

3. In a multi-position window having a window frame, a sash frame being rotatable out of the window frame on at least two different axis, a drive train mounted on at least one side of said sash frame for longitudinal movement along a length of the side to a plurality of positions and being operatively connected to pivot means for changing the axis of rotation of said sash from a first axis when said drive train is at a first position to a second axis when said drive train is at a second position, an improvement comprising; a bolt, a strike configured to receive said bolt, one of said strike and bolt being mounted on said window frame fixed against said longitudinal movement of said drive train, the other of said strike and bolt being mounted fixed on said drive train for movement by said drive train along said side and so that said strike and bolt are in alignment for said strike to receive said bolt when said drive train is in the second position and said strike and said bolt are out of alignment for said strike to receive said bolt when said drive train is in the first position, said bolt comprising means for resiliently urging said bolt into said strike, and a surface on said strike slidingly camming on a surface on said bolt to move said bolt out of said strike when said strike and said bolt are being moved across one another longitudinally with said drive train out of alignment by movement of said drive train from the second position to the first position, said bolt in said strike preventing rotation of said sash frame out of said window frame.

4. In a multi-position window having a window frame, a sash frame being rotatable out of the window frame on at least two different axis, a drive train mounted on at least one side of said sash frame for longitudinal movement along a length of the side to a plurality of positions and being operatively connected to pivot means for changing the axis of rotation of said sash from a first axis when said drive train is at a first position to a second axis when said drive train is at a second position, an improvement comprising;

a bolt, a strike configured to receive said bolt, one of said strike and bolt being mounted on said window frame fixed against said longitudinal movement of said drive train, the other of said strike and bolt being mounted fixed on said drive train for movement by said drive train along said side and so that said strike and bolt are in alignment for said strike to receive said bolt when said drive train is in the second position and said strike and said bolt are out of alignment for said strike to receive said bolt when said drive train is in the first position, a hole in the sash frame that is in alignment with said bolt and said strike when said drive train is in the second position for insertion of a key through said hole for moving said bolt out of said strike, and that is in alignment with one of said bolt and said strike and out of alignment with the other of said bolt and said strike when said drive train is in the first position.

5. In a multi-position window having a window frame, a sash frame being rotatable out of the window frame on at least two different axis, a drive train mounted on at least one side of said sash frame for longitudinal movement along a length of the side to a plurality of positions and being operatively connected to pivot means for changing the axis of rotation of said sash from a first axis when said drive train is at a first position to a second axis when said drive train is at a second position, an improvement comprising;

a bolt, a strike configured to receive said bolt, one of said strike and bolt being mounted on said window frame fixed against said longitudinal movement of said drive train, the other of said strike and bolt being mounted fixed on said drive train for movement by said drive train along said side and so that said strike and bolt are in alignment for said strike to receive said bolt when said drive train is in the second position and said strike and said bolt are out of alignment for said strike to receive said bolt when said drive train is in the first position, a hole in the sash frame that is in alignment with said bolt, said strike, and a hole in said drive train when said drive train is in the second position for insertion of a key through the hole in said sash frame for moving said bolt out of said strike, and that is in alignment with one of said bolt and said strike and out of alignment with the other of said bolt and said strike when said drive train is in the first position.

* * * * *